US007906209B2

(12) United States Patent
Higami et al.

(10) Patent No.: US 7,906,209 B2
(45) Date of Patent: Mar. 15, 2011

(54) FIBER FOR ARTIFICIAL HAIR WITH IMPROVED PROCESSABILITY AND HAIR ACCESSORY USING THE SAME

(75) Inventors: Tomokazu Higami, Himeji (JP); Seiichi Sakurai, Himeji (JP); Satoru Harada, Kakogawa (JP)

(73) Assignee: Kaneka Corporation, Osaka-Shi (JP)

( * ) Notice: Subject to any disclaimer, the term of this patent is extended or adjusted under 35 U.S.C. 154(b) by 58 days.

(21) Appl. No.: 12/441,441

(22) PCT Filed: Sep. 19, 2007

(86) PCT No.: PCT/JP2007/068189

§ 371 (c)(1),
(2), (4) Date: Mar. 16, 2009

(87) PCT Pub. No.: WO2008/035712

PCT Pub. Date: Mar. 27, 2008

(65) Prior Publication Data

US 2009/0266372 A1 Oct. 29, 2009

(30) Foreign Application Priority Data

Sep. 21, 2006 (JP) ..... 2006-256117

(51) Int. Cl.
*D02G 3/00* (2006.01)

(52) U.S. Cl. ..... 428/397; 428/399

(58) Field of Classification Search ..... 428/397, 428/399, 364

See application file for complete search history.

(56) References Cited

U.S. PATENT DOCUMENTS

| | | | | |
|---|---|---|---|---|
| 5,626,961 | A * | 5/1997 | Aneja | 428/397 |
| 5,677,059 | A * | 10/1997 | Kakita et al. | 428/397 |
| 5,683,814 | A * | 11/1997 | Kakita et al. | 428/401 |
| 5,834,119 | A * | 11/1998 | Roop | 428/397 |
| 5,976,693 | A * | 11/1999 | Miyoshi et al. | 428/372 |
| 6,556,586 | B1 * | 4/2003 | Sipila | 370/469 |
| 6,673,450 | B2 * | 1/2004 | Boyle et al. | 428/397 |
| 6,841,247 | B2 * | 1/2005 | Blackwell et al. | 428/397 |
| 6,959,188 | B2 * | 10/2005 | Sasaki et al. | 455/435.1 |
| 7,501,177 | B2 * | 3/2009 | Harada | 428/357 |

(Continued)

FOREIGN PATENT DOCUMENTS

JP 1985-162868 8/1985

(Continued)

OTHER PUBLICATIONS

International Search Report for International Application No. PCT/JP2007/068189 dated Jan. 4, 2008.

*Primary Examiner* — N. Edwards

(74) *Attorney, Agent, or Firm* — Kratz, Quintos & Hanson, LLP

(57) ABSTRACT

An artificial hair which is composed of synthetic fibers such as acrylic fibers or vinyl chloride fibers and which is characterized in that the cross section of each fiber has a shape consisting of one major axis and at least two minor axes nearly perpendicular to the major axis and that the single-fiber fineness is 25 to 70 dtex. This artificial hair is soft to the touch and bulky (voluminous) to impart a good feel to hair accessories and exhibits excellent combing properties and braidability, thus giving hair accessories (such as wigs, hairpieces, braids, extension hair and doll hair) which have excellent feel and settability.

13 Claims, 3 Drawing Sheets

U.S. PATENT DOCUMENTS 7,560,159 B2 * 7/2009 Goda et al. ..... 428/397

FOREIGN PATENT DOCUMENTS

| | | |
|---|---|---|
| JP | 61-89321 | 5/1986 |
| JP | 3-51349 | 3/1991 |
| JP | 4-18116 | 1/1992 |
| JP | 6-81207 | 3/1994 |
| JP | 8-296112 | 11/1996 |
| JP | 8-296115 | 11/1996 |
| JP | 8-302519 | 11/1996 |
| JP | 9-132813 | 5/1997 |
| JP | 10-168647 | 6/1998 |

* cited by examiner

FIBER FOR ARTIFICIAL HAIR WITH IMPROVED PROCESSABILITY AND HAIR ACCESSORY USING THE SAME

TECHNICAL FIELD

The present invention relates to fibers for artificial hair for the decoration of hair on the head, such as wigs, hair pieces, braids, extension hair, and doll's hair and hair accessories using the same.

BACKGROUND ART

In general, as synthetic fibers for artificial hair for the decoration of hair on the head, such as wigs and hair pieces, acrylic synthetic fibers or vinyl chloride synthetic fibers are frequently used.

Conventionally, as fibers for artificial hair having bulkiness and soft texture, fibers having a Y-shaped cross section in which three projections extend from a central connecting part in three directions and a portion near the top of each projection becomes narrow have been proposed (see Patent Document 1). Moreover, as fibers for artificial hair which are naturally shiny and have soft texture, fibers having a cross section in which three or more projections radially extend from one central connecting part and groove-like irregularities parallel to the direction of the fiber axis are provided have been proposed (see Patent Document 2). However, these fibers have room for improvement as fibers for artificial hair in terms of processability, such as smoothness of combing and ease of braiding hair into three strands. Moreover, as fibers for artificial hair excellent in processability at the time of crimping or braiding hair into three strands, fibers which have a flat cross section and which are bent or curved at an angle exceeding 90° at one portion or two portions have been proposed (see Patent Document 3). However, in the case of such flat fibers, bulkiness has been insufficient.

Conventionally, fibers having modified flat cross sections with various shapes are known. For example, Japanese Unexamined Patent Publication No. 60-162868 relates to an electrically-conductive polyester filament, and describes fibers having a trunk and two projections extending in opposite directions with the trunk interposed therebetween as fibers on which a metal coating is hard to form uniformly and easily (see Comparative Example 1 and FIG. 3E of Cited Reference 4). However, Japanese Unexamined Patent Publication No. 60-162868 describes that this polyester filament is used for producing an electrically conductive filament by chemical plating, but does not describe that the polyester filament is applied to artificial hair. Japanese Unexamined Patent Publication No. 61-89321 describes a highly dyeable polyester fiber which is flat and has two projections at each of the outer peripheral parts across the major axis (see FIG. 1 of Cited Reference 5 and, for the shape of a nozzle outlet, FIG. 4 thereof). However, Japanese Unexamined Patent Publication No. 61-89321 describes a fiber which has a single yarn fineness of 0.5 to 8 deniers (about 0.6 to 8.9 dtex) and is formed into yarn to be used for woven and knitted articles (see the left upper column, lines 8 to 14 on page 4 of Cited Reference 5), but does not describe that the fiber is applied to artificial hair. Moreover, the fiber is excessively thin as artificial hair, and is difficult to process. Furthermore, Japanese Unexamined Patent Publication No. 3-51349 describes a fiber having a modified cross section which has an oval shape with an ellipticity of 1.2 to 2.5 and in which two projections crossing the major axis at a flat part and extending from each of both sides of the major axis are provided at intervals (see Patent Document 6). However, Japanese Unexamined Patent Publication No. 3-51349 describes a polyester fiber forming a pile part of a napped pile fabric for car seats, but does not describe that the fiber is applied to artificial hair. Moreover, the single yarn denier of the polyester fiber is 0.7 to 4.0 (about 0.8 to 4.4 dtex) (see the lower right column, lines 18 to 19 on page 2 of Patent Document 6). Since the size of the fiber is excessively thin, the fiber is not suitable for an artificial hair application. Furthermore, Japanese Unexamined Patent Publication No. 6-81207 describes a fiber having a specific cross section in which two projections crossing the major axis at a flat part and extending from each of both sides of the major axis are provided at intervals (see claim 1 and FIG. 1 of Cited Reference 7). However, Japanese Unexamined Patent Publication No. 6-81207 describes that the fiber having a specific cross section is used for panty hose as covering yarn, but does not describe that the fiber is applied to artificial hair. Moreover, the single yarn denier of the specific cross section is 1.0 to 5.0 (about 1.2 to 5.5 dtex). Since the size of the fiber is excessively thin, the fiber is not suitable for an artificial hair application.

Patent Document 1: Japanese Unexamined Patent Publication No. 8-296112

Patent Document 2: Japanese Unexamined Patent Publication No. 8-296115

Patent Document 3: Japanese Unexamined Patent Publication No. 9-132813

Patent Document 4: Japanese Unexamined Patent Publication No. 60-162868

Patent Document 5: Japanese Unexamined Patent Publication No. 61-89321

Patent Document 6: Japanese Unexamined Patent Publication No. 3-51349

Patent Document 7: Japanese Unexamined Patent Publication No. 6-81207

DISCLOSURE OF THE INVENTION

Technical Problems to be Solved

As described above, among conventional fibers developed to be used as artificial hair, fibers having a Y-shaped cross section in which bulkiness required for giving favorable texture to hair decoration products, such as braids, is emphasized have had problems that combing is not smooth due to complicated cross sectional shapes of the fibers and braiding is difficult. In contrast, fibers having a relatively simple cross sectional shape have favorable processability, but, due to insufficient bulkiness, the texture at the time when formed into hair decoration products, such as braids, is not sufficient. Moreover, among other fibers having various modified cross sections, there have been no fibers suitable for an artificial hair application. Then, an object of the present invention is to provide fibers for artificial hair which have bulkiness required for giving favorable texture to hair decoration products, such as braids, allow smooth coming, and are easy to braid and hair accessories using the same.

Means to Solve the Problems

Fibers for artificial hair and artificial hair of the present invention in which the above-described problems are solved contain a synthetic fiber having a cross sectional shape formed of a single major axis and at least two minor axes substantially orthogonal to the major axis and having a single yarn fineness of 25 to 70 dtex.

Hair accessories of the present invention are obtained by bundling the artificial hair. Furthermore, the bundled artificial hair may be used as hair accessories.

The artificial hair of the present invention can be suitably used for the decoration of hair on a head. Specifically, the artificial hair of the present invention can be suitably used in hair accessories, such as wigs, hair pieces, braids, extension hair, and doll's hair. It should be noted that the braid refers to artificial hair for the decoration of hair on the head which is braided in self hair. The braiding manner is classified into two kinds: braiding hair into three strands and braiding hair into two strands, which is referred to as "twist". In general, for braiding hair into three strands, relatively rough crimping referred to as "regular crimp" is performed and for the "twist", finer crimping referred to as "micro crimp" is performed.

EFFECTS OF THE INVENTION

The artificial hair and the hair accessories according to the present invention have soft texture and bulkiness (volume) which give favorable texture as hair accessories, allows smooth combing, and is easy to braid. Therefore, when the artificial hair is used in wigs, hairpieces, braids, extension hair, doll's hair, etc., hair accessories having favorable texture and excellent processability can be provided.

BEST MODES FOR CARRYING OUT THE INVENTION

Figure 1:
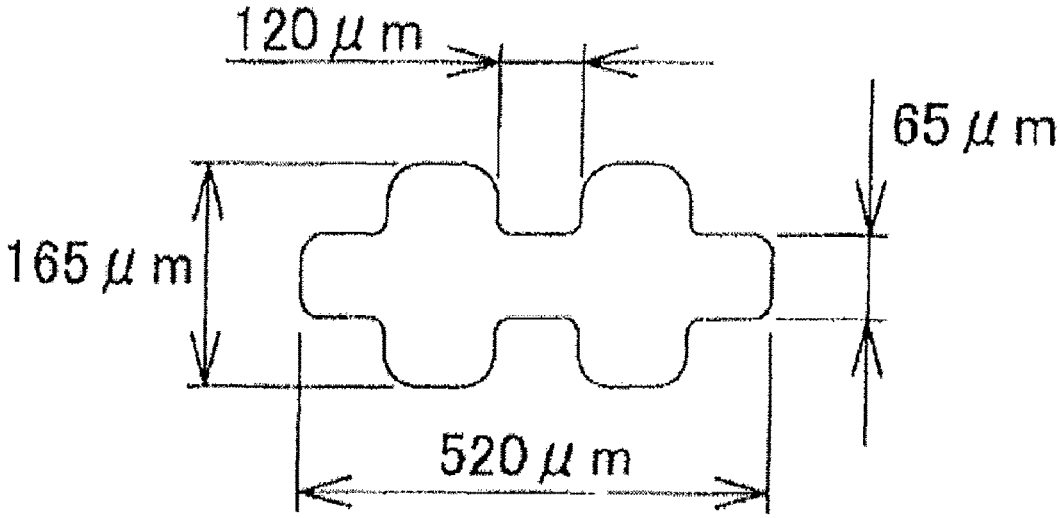
FIG. 1 is an explanatory view illustrating an example of a nozzle opening shape for obtaining fibers for artificial hair according to the present invention.

Fibers for artificial hair and artificial hair according to the present invention contains synthetic fibers, and preferably contain an acrylic fiber or a vinyl chloride fiber in terms of texture and glossiness as artificial hair.

The acrylic fiber is preferably a fiber in which a polymer forming the fiber contains acrylonitrile in a proportion of 30% by weight or more. As the polymer forming the acrylic fiber, a vinyl monomer which can be copolymerized with acrylonitrile may be copolymerized in addition to acrylonitrile. Examples of the vinyl monomer which can be copolymerized with acrylonitrile include vinyl chloride, vinylidene chloride, vinyl bromide, vinylidene bromide, acrylic ester, methacrylic acid ester, acrylamide, and methacrylamide. Moreover, monoalkyl-substituted substances or dialkyl-substituted substances of the vinyl monomer may be used. In addition thereto, for example, acrylic acid, methacrylic acid, itaconic acid, styrene sulfonic acid, methallyl sulfonic acid, methacroyl oxybenzene sulfonic acid, methacroyl oxypropylsulfonic acid, etc., are mentioned, and metal salts thereof may be used. Furthermore, ammonium, amine salts, glycidyl acrylate, glycidyl methacrylate, acryl glycidyl ether, methallyl glycidyl ether, etc., are mentioned. Among the above, substances obtained by copolymerization of vinyl chloride or vinylidene chloride are improved in texture, have thermoplasticity, and are excellent in fire retardancy, and thus are suitable as fibers for hair.

In a vinyl chloride fiber used for the present invention, a polymer forming the fiber may be conventionally known substances, such as a homopolymer which is a homopolymer of vinyl chloride and various copolymer resins, and is not limited. Typical examples of the copolymer resin include copolymer resins of vinyl chloride and vinyl esters, such as a vinyl chloride-vinyl acetate copolymer resin and a vinyl chloride-vinyl propionate copolymer resin; copolymer resins of vinyl chloride and acrylic esters, such as a vinyl chloride-butyl acrylate copolymer resin and a vinyl chloride-acrylic acid 2-ethylhexyl copolymer; copolymer resins of vinyl chloride and olefins, such as a vinyl chloride-ethylene copolymer resin and a vinyl chloride-propylene copolymer resin; and a vinyl chloride-acrylonitrile copolymer resin. Among the above, examples of a vinyl chloride resin suitable for the present invention include a homopolymer resin which is a homopolymer of vinyl chloride, a vinyl chloride-ethylene copolymer resin, and a vinyl chloride-vinyl acetate copolymer resin. The content of a comonomer in these copolymer resins is not limited, and can be determined according to molding processability at the time of producing fibers, properties of fibers to be obtained, etc.

In the present invention, a chlorinated vinyl chloride resin can be used as the vinyl chloride resin forming the vinyl chloride fibers. As the chlorinated vinyl chloride resin, it is preferable to use a substance in which the chlorine content is increased to 58 to 73% by reacting chlorine with vinyl chloride resin as a raw material. Since the heat resistance of resin is increased by chlorination, the use of the chlorinated vinyl chloride resin produces an effect that thermal contraction of the fibers becomes difficult to occur.

To the vinyl chloride resin used in the present invention, a thermostabilizer, a lubricant, etc., can be suitably added. As the thermostabilizer, conventionally known substances can be used. In particular, a tin-based thermostabilizer, a Ca—Zn-based thermostabilizer, a hydrotalcite-based thermostabilizer, an epoxy-based thermostabilizer, a β-diketone-based thermostabilizer, etc., are preferable.

As the fibers for artificial hair of the present invention, various synthetic fibers other than the acrylic fiber or the vinyl chloride fiber, such as polyester fibers, polyamide fibers, and polypropylene fibers, can also be used.

Figure 4:
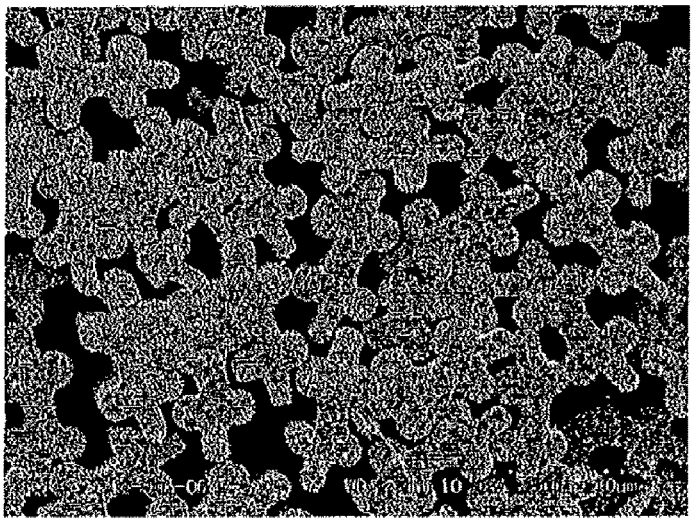
FIG. 4 is a micrograph of transverse cross sections of the fibers illustrating an example of artificial hair according to the present invention.

In the artificial hair of the present invention, the transverse cross sectional shape of a synthetic fiber forming the artificial hair (hereinafter referred to as "fiber for artificial hair") contains a single major axis and at least two minor axes substantially orthogonal to the major axis. As an opening shape of a spinning nozzle for obtaining a fiber having such a cross sectional shape, the shape shown in FIG. 1 is mentioned, for example. The nozzle opening has a shape in which two projections extending from each of both sides of the single major axis (lateral axis) are provided at intervals. The transverse cross sectional shape of a fiber spun from the nozzle having such an opening shape becomes a shape formed of a single major axis and two minor axes substantially orthogonal to the major axis, in which two "+" are apparently put horizontally in a row as shown in FIG. 4, for example. The length ratio of the major axis to the minor axis is based on the fiber fineness, and thus is not limited. The ratio is usually within the range of 2:1 to 5:1, and preferably within the range of about 3:1 to about 4:1. When the major axis is excessively long, there is a tendency that elasticity of fibers decreases. The number of the minor axes crossing the major axis is at least 2, and preferably 2 to 3.

The single yarn fineness of the fibers for artificial hair is 25 to 70 dtex, more preferably 30 to 70 dtex, and still more preferably 30 to 60 dtex. As the size of fibers decreases so that the single yarn fineness reaches less than 25 dtex, the fibers are excessively softened, which results in lost elasticity, decreasing bulky feeling as artificial hair. In contrast, as the size of a fiber increases so that the single yarn fineness exceeds 70 dtex, rigidity excessively increases, forming the fibers into products, such as braids, becomes difficult, and the texture become unnatural. Therefore, it is required to adjust the fiber fineness to the above-mentioned suitable fineness. The fibers for artificial hair may be a multifilament (fiber bundle) or a monofilament. In general, the fibers for artificial hair are formed into a multifilament obtained by simultaneously spinning a plurality of fibers from a spinning nozzle in a spinning process mentioned later, and bundling the same.

The fibers for artificial hair may be produced in the same manner as in conventional methods of producing acrylic fibers or vinyl chloride fibers, and the production methods are not limited.

In the case of acrylic fibers, for example, a polymer containing acrylonitrile in a proportion of 30% by weight or more is dissolved in an organic solvent, such as acetone, acetonitrile, and dimethylformamide to form a spinning stock solution, and a wet spinning method is employed. It should be noted that, to the fibers for artificial hair, a stabilizer which is effective for lightfastness or the like may be added. Moreover, a suitable amount of various additives for adjusting glossiness may be added. Furthermore, in order to form colored fibers, a pigment, a dye, etc., may be suitably used.

Vinyl chloride fibers are produced by a known melt spinning method. For example, a vinyl chloride resin, a thermostabilizer, a lubricant, etc., are mixed at given proportions. The mixture is stirred and mixed with a Henschel mixer or the like. Then, the resultant is charged in an extruder, extruded under favorable spinning conditions of a cylinder temperature of 150 to 190° C. and a nozzle temperature of 180±15° C., and then subjected to melt spinning. As required, a stabilizer which is effective for lightfastness or the like or various additives for adjusting glossiness may be added. Furthermore, in order to form colored fibers, a pigment, a dye, etc., may be suitably added.

The hair accessories according to the present invention are obtained by crimping a fiber bundle in which artificial hair containing the above-mentioned synthetic fibers are bundled. The crimping process as referred to herein refers to a gear crimping method which successively gives a wave shape to a filament yarn by sandwiching the filament yarn between two gear-shaped rolls or a process which gives a wave shape to a filament yarn by successively stuffing the filament yarn heated by steam or the like into a stuffing box. By the processing methods, hair accessories which contain the above-mentioned synthetic fibers and in which glossiness of the artificial hair is moderately adjusted are obtained, and a wave shape suitable for a target hair decoration product can be given, which increases processability at the time of forming braids, extension hair, etc.

The artificial hair of the present invention and the hair accessories using the same are preferably used for the decoration of hair on the head, such as wigs, hairpieces, braids, extension hair, and doll's hair. The hair accessories which have been subjected to the crimping processes, such as gear crimping, as described above are excellent in processability, such as smoothness of combing and ease of braiding, and are suitable particularly for braids, extension hair, etc.

EXAMPLES

Prior to the description of Examples, evaluation methods will be described below. Fibers for artificial hair of articles subjected to regular crimp (RC; 7 mm gear crimp) and articles subjected to micro crimp (MC; 2 mm gear crimp) after crimping and before braiding were evaluated for 6 items of <texture>, <smoothness of combing>, <ease of braiding>, <volume after braiding>, <glossiness>, and <difficulty of raveling> by a sensory evaluation test, and graded on a scale of 1 to 5. Hereinafter, details of each evaluation method will be described below.

<Texture>

A fiber bundle (Fiber length of 70 cm and Hair bundle weight of 7.0 g) after crimping and before braiding was hung. Then, smoothness at the time of passing a finger through the fiber bundle and soft texture at the time when the fiber hit the finger were evaluated on a scale of 1 to 5 according to the following criteria.

5: Fibers are not caught around the finger and the texture is very soft (Based on Double cross, 36 dtex).

4: Fibers are hardly caught around the finger and the texture is soft.

3: Fibers are somewhat caught around the finger but the texture is soft (Y-shaped regular crimp (RC), 51 dtex).

2: Fibers are caught around the finger and the texture is hard.

1: Fibers are easy to be caught around the finger and the texture is hard.

<Smoothness of Combing>

A fiber bundle (Fiber length of 70 cm and Hair bundle weight of 7.0 g) after crimping and before braiding was hung. Then, smoothness of combing at the time of passing a comb through the fiber bundle was evaluated on a scale of 1 to 5 according to the following criteria.

5: A comb is not caught in the fiber bundle and smoothly passes (Based on Double cross, 36 dtex).

4: A comb is hardly caught in the fiber bundle and smoothly passes.

3: A comb is somewhat caught in the fiber bundle and smoothly passes (Dumbbell (H), micro crimp (MC), 36 dtex).

2: A comb is caught in the fiber bundle and does not smoothly pass.

1: A comb is caught in the fiber bundle and hardly passes.

<Ease of Braiding>

Ease of braiding at the time of braiding, into three strands, or twisting a fiber bundle (Fiber length of 70 cm and Hair bundle weight of 7.0 g) after crimping and before braiding was evaluated on a scale of 1 to 5 according to the following criteria.

5: Yarn of "base braiding" is not entangled at the time of braiding and the finger is not damaged at the time of braiding (Based on Double cross, 36 dtex).

4: Yarn of "base braiding" is hardly entangled at the time of braiding and the finger is not damaged at the time of braiding.

3: Yarn of "base braiding" is hardly entangled at the time of braiding but the finger is easily damaged at the time of braiding (Y-shaped regular crimp (RC), 51 dtex).

2: Yarn of "base braiding" is sometimes entangled at the time of braiding and the finger is easily damaged at the time of braiding.

1: Yarn of "base braiding" is frequently entangled at the time of braiding and the finger is easily damaged at the time of braiding.

<Difficulty of Raveling>

A crimped fiber bundle was twisted to the end. Then, the degree of raveling of the end was evaluated on a scale of 1 to 5 according to the following criteria.

5: The fiber bundle end after braiding did not ravel.

4: The fiber bundle end after braiding hardly raveled (Y shape, regular crimp (RC), 51 dtex).

3: The fiber bundle end after braiding somewhat raveled.

2: The fiber bundle end after braiding easily raveled.

1: The fiber bundle end after braiding almost raveled.

<Volume After Braiding>

Three kinds of fiber bundles after braiding into three strands or twisting were put side by side, and then evaluated on a scale of 3 to 5 according to the following criteria so that the fiber bundle having high bulkiness (volume) was highly evaluated.

5: Y shape, regular crimp (RC), 51 dtex

4: Y shape, regular crimp (RC), 36 dtex

3: Dumbbell (H), micro crimp (MC), 36 dtex

<Glossiness>

A fiber bundle after crimping and before braiding was irradiated with natural light, and then glitter feeling due to reflected light from the fiber bundle was evaluated on a scale of 1 to 5 while grading the fiber bundle having the most glitter (double cross, regular crimp (RC), 75 dtex) as 5, the fiber bundle (dumbbell (H), micro crimp (MC), 36 dtex) as 3, and the fiber bundle having the lowest glitter as 1.

Example 1

A copolymer-resin raw material containing 49% by weight of acrylonitrile, 50% by weight of vinyl chloride, and 1% by weight of sodium styrene sulfonate was dissolved in acetone to prepare 28.5% by weight of spinning stock solution. The spinning stock solution was wet-spun in a 29% by weight aqueous acetone solution using a spinning nozzle (Number of openings: 100) having an opening shape as shown in FIG. 1 in which two projections extending from each of both sides of a single major axis (lateral axis) are provided at intervals. The obtained fiber was stretched 1.5 times in a hot water bath of 60° C. to 75° C., subsequently dried at 120° C., hot stretched 1.8 times, and further subjected to relaxation beat treatment (0.92 time) at 160° C. The single yarn fineness of this fiber was 36 dtex. Scanning electronic microscopic observation of the transverse cross sectional shape of this fiber revealed that the fiber had a cross sectional shape formed of a single major axis and two minor axes substantially orthogonal to the major axis in which "+" are apparently put horizontally in a row (++; double cross) substantially similarly to a nozzle opening as shown in FIG. 4. The acrylic fibers for artificial hair thus produced were subjected to two kinds of gear crimping: 7 mm (regular crimp; RC) or 2 mm (micro crimp; MC). Then, a braid was produced using the fiber bundle (Fiber length of 70 cm and Hair bundle weight of 7.0 g) after crimping.

Furthermore, fibers for acrylic artificial hair having a single yarn fineness of 25 dtex, 30 dtex, 46 dtex, 51 dtex, 60 dtex, 66 dtex, and 70 dtex and having the similar transverse cross sectional shape (++; double cross) were obtained, while keeping the nozzle as it was, in the same manner as above, except changing the conditions of bath stretching, hot stretching, and relaxation heat treatment as shown in Table 1.

Comparative Example 1

Figure 2:
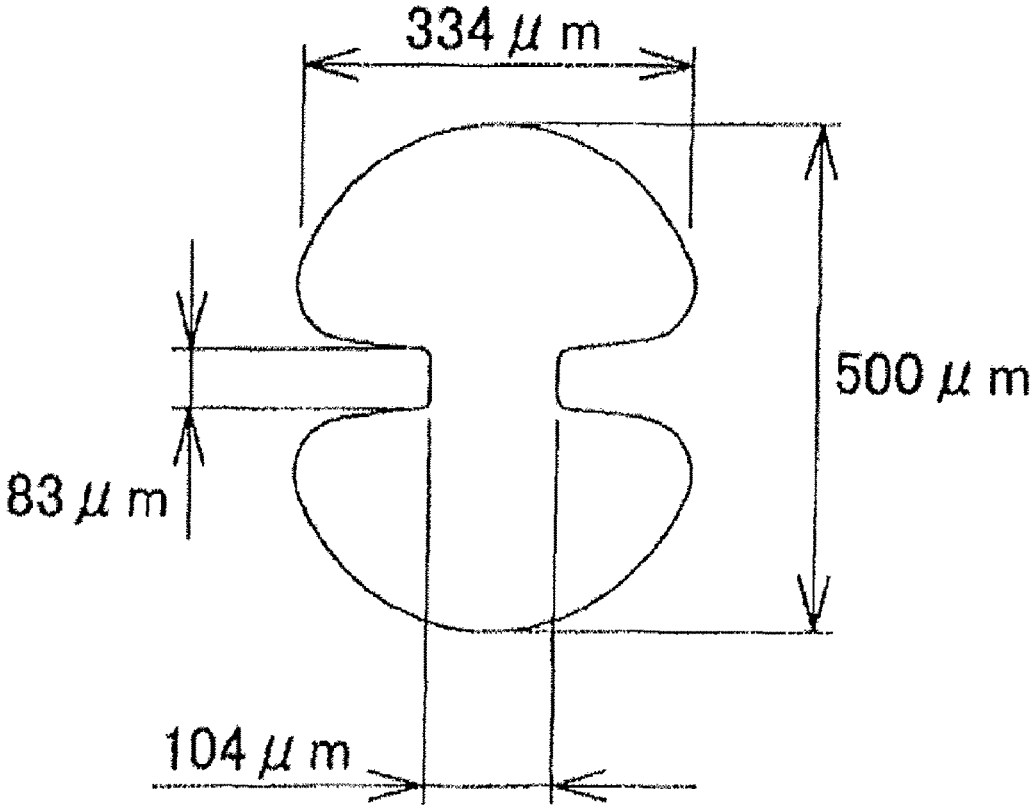
FIG. 2 is an explanatory view illustrating a nozzle opening shape for obtaining fibers having dumbbell-shaped cross sections of Comparative Example 1.
Figure 5:
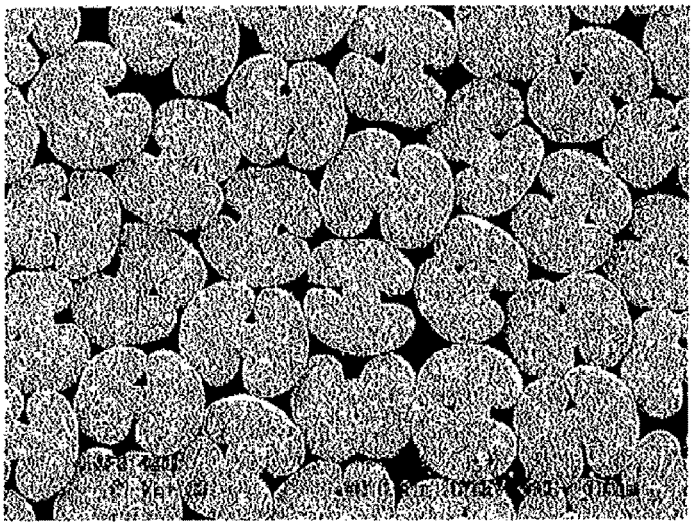
FIG. 5 is a micrograph of transverse cross sections of the fibers having dumbbell-shaped cross sections of Comparative Example 1.
Figure 6:
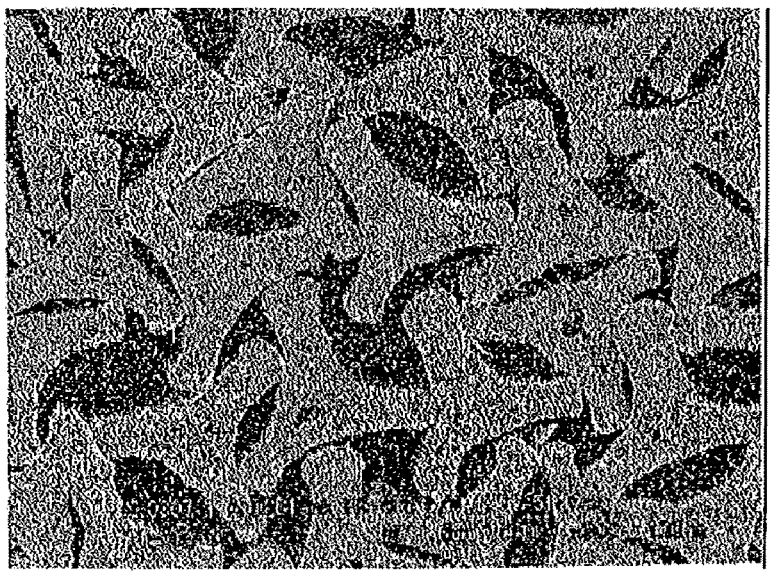
FIG. 6 is a micrograph of transverse cross section of the fibers having Y-shaped cross sections of Comparative Example 2.

Three kinds of acrylic fibers for artificial hair having a single yarn fineness of 36 dtex, 46 dtex, and 66 dtex were spun using a dumbbell-shaped (H type) spinning nozzle (Number of openings: 50) having an opening shape as shown in FIG. 2 in the same manner as in Example 1, except changing the conditions of bath stretching, hot stretching, and relaxation heat treatment as shown in Table 1. Scanning electron microscopic observation of the transverse cross sectional shape of this fiber revealed that the fiber had a dumbbell shape close to a circular shape as shown in FIG. 5. The acrylic fibers for artificial hair thus produced were subjected to 2 mm gear crimping (micro crimp; MC). Then, a braid was produced using the fiber bundle (Fiber length of 70 cm and Hair bundle weight of 7.0 g) after crimping.

Comparative Example 2

Figure 3:
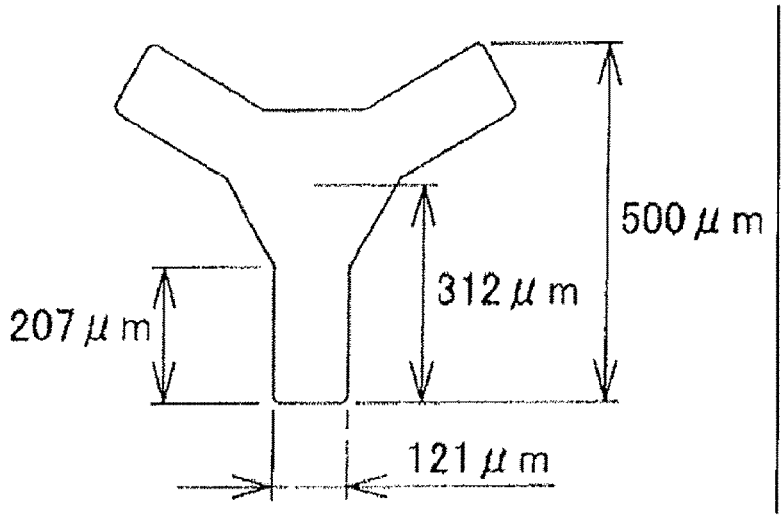
FIG. 3 is an explanatory view illustrating a nozzle opening shape for obtaining fibers having Y-shaped cross sections of Comparative Example 2.

Two kinds of acrylic fibers for artificial hair having a single yarn fineness of 36 dtex and 51 dtex were spun using a Y-shaped spinning nozzle (Number of openings: 50) having an opening shape as shown in FIG. 3 in the same manner as in Example 1, except changing the conditions of bath stretching, hot stretching, and relaxation heat treatment as shown in Table 1. The acrylic fibers for artificial hair thus produced were subjected to 7 mm gear crimping (regular crimp; RC). Then, a braid was produced using the fiber bundle (Fiber length of 70 cm and Hair bundle weight of 7.0 g) after crimping.

Comparative Examples 3 and 4

Fibers for artificial hair having a single yarn fineness of 20 dtex and 75 dtex and having the similar lateral cross sectional shape (++; double cross) were obtained, while keeping the nozzle as it was, in the same manner as in Example 1, except changing the conditions of bath stretching, hot stretching, and relaxation treatment as shown in Table 1.

TABLE 1

| | Production conditions | | | |
|---|---|---|---|---|
| | Fiber fineness | Bath stretching (times) | Hot stretching (times) | Relaxation heat treatment (times) |
| Example 1(++) | 25 dtex | 1.5 | 2.6 | 0.92 |
| | 30 dtex | 1.5 | 2.2 | 0.92 |
| | 36 dtex | 1.5 | 1.8 | 0.92 |
| | 46 dtex | 1.5 | 1.6 | 0.92 |
| | 51 dtex | 1.5 | 1.5 | 0.92 |
| | 60 dtex | 1.5 | 1.3 | 0.92 |
| | 66 dtex | 1.5 | 1.2 | 0.92 |
| | 70 dtex | 1.5 | 1.1 | 0.92 |
| Comparative Example 1(Dumbbell) | 36 dtex | 2.0 | 2.9 | 0.92 |
| | 46 dtex | 2.0 | 2.3 | 0.92 |
| | 66 dtex | 2.0 | 1.6 | 0.92 |
| Comparative Example 2(Y-SHAPED) | 36 dtex | 2.0 | 3.3 | 0.92 |
| | 51 dtex | 2.0 | 2.3 | 0.92 |
| Comparative Example 3(++) | 20 dtex | 1.5 | 3.3 | 0.92 |
| Comparative Example 4(++) | 75 dtex | 1.4 | 1.1 | 0.92 |

The fibers and braids produced in Example 1 and Comparative Examples 1 to 4 obtained by the above-described method were evaluated for texture, smoothness of combing, ease of braiding, volume after braiding, glossiness, and difficulty of raveling. The results are shown in Tables 2-1 and 2-2.

TABLE 2-1

| | | Evaluation | | | | | |
|---|---|---|---|---|---|---|---|
| | | Example 1 | | Comparative Example 1 | Comparative Example 2 | Comparative Example 3, 4 | |
| | | Cross sectional shape | | | | | |
| | Fiber | Double cross (++) | | Dumbbell(H) | Y-SHAPED | Double cross (++) | |
| | | Crimp shape | | | | | |
| | fineness | RC | MC | MC | RC | RC | MC |
| Texture | 20 dtex | | | | | 5 | 5 |
| | 25 dtex | 5 | 5 | | | | |
| | 30 dtex | 5 | 5 | | | | |
| | 36 dtex | 5 | 5 | 4 | 3 | | |
| | 46 dtex | 5 | 5 | 4 | | | |
| | 51 dtex | 4 | 5 | | 3 | | |
| | 60 dtex | 4 | 4 | | | | |
| | 66 dtex | 4 | 4 | 3 | | | |
| | 70 dtex | 4 | 4 | | | | |
| | 75 dtex | | | | | 3 | 3 |
| Smoothness of combing | 20 dtex | | | | | 3 | 2 |
| | 25 dtex | 4 | 4 | | | | |
| | 30 dtex | 5 | 5 | | | | |
| | 36 dtex | 5 | 5 | 3 | 2 | | |
| | 46 dtex | 5 | 5 | 4 | | | |
| | 51 dtex | 5 | 5 | | 2 | | |
| | 60 dtex | 5 | 5 | | | | |
| | 66 dtex | 5 | 5 | 4 | | | |
| | 70 dtex | 5 | 5 | | | | |
| | 75 dtex | | | | | 5 | 5 |
| Ease of braiding | 20 dtex | | | | | 5 | 5 |
| | 25 dtex | 5 | 5 | | | | |
| | 30 dtex | 5 | 5 | | | | |
| | 36 dtex | 5 | 5 | 4 | 3 | | |
| | 46 dtex | 5 | 5 | 4 | | | |
| | 51 dtex | 4 | 4 | | 3 | | |
| | 60 dtex | 4 | 4 | | | | |
| | 66 dtex | 3 | 3 | 3 | | | |
| | 70 dtex | 3 | 3 | | | | |
| | 75 dtex | | | | | 2 | 2 |

Notes)
Crimp shape
RC: Regular crimp (7 mm gear crimp)
MC: Micro crimp (2 mm gear crimp)

TABLE 2-2

| | | Evaluation | | | | | |
|---|---|---|---|---|---|---|---|
| | | Example 1 | | Comparative Example 1 | Comparative Example 2 | Comparative Example 3, 4 | |
| | | Cross sectional shape | | | | | |
| | Fiber | Double cross (++) | | Dumbbell (H) | Y-SHAPED | Double cross (++) | |
| | | Crimp shape | | | | | |
| | fineness | RC | MC | MC | RC | RC | MC |
| Volume after braiding | 20 dtex | | | | | 3 | 3 |
| | 25 dtex | 3 | 3 | | | | |
| | 30 dtex | 3 | 3 | | | | |
| | 36 dtex | 3 | 3 | 3 | 4 | | |
| | 46 dtex | 4 | 4 | 4 | | | |
| | 51 dtex | 4 | 4 | | 5 | | |
| | 60 dtex | 4 | 4 | | | | |
| | 66 dtex | 4 | 4 | 4 | | | |
| | 70 dtex | 4 | 4 | | | | |
| | 75 dtex | | | | | 4 | 4 |

TABLE 2-2-continued

| | | Evaluation | | | | | |
|---|---|---|---|---|---|---|---|
| | | Example 1 | | Comparative Example 1 | Comparative Example 2 | Comparative Example 3, 4 | |
| | | Cross sectional shape | | | | | |
| | Fiber | Double cross (++) | | Dumbbell (H) | Y-SHAPED | Double cross (++) | |
| | | Crimp shape | | | | | |
| | fineness | RC | MC | MC | RC | RC | MC |
| Glossiness | 20 dtex | | | | | 4 | 4 |
| | 25 dtex | 4 | 4 | | | | |
| | 30 dtex | 4 | 4 | | | | |
| | 36 dtex | 4 | 4 | 3 | 4 | | |
| | 46 dtex | 4 | 4 | 4 | | | |
| | 51 dtex | 4 | 4 | | 4 | | |
| | 60 dtex | 4 | 4 | | | | |
| | 66 dtex | 4 | 4 | 4 | | | |
| | 70 dtex | 5 | 5 | | | | |
| | 75 dtex | | | | | 5 | 5 |
| Difficulty of raveling | 20 dtex | | | | | 2 | 3 |
| | 25 dtex | 3 | 4 | | | | |
| | 30 dtex | 3 | 4 | | | | |
| | 36 dtex | 3 | 4 | 4 | 4 | | |
| | 46 dtex | 3 | 4 | 4 | | | |
| | 51 dtex | 3 | 4 | | 4 | | |
| | 60 dtex | 3 | 4 | | | | |
| | 66 dtex | 3 | 4 | 4 | | | |
| | 70 dtex | 3 | 4 | | | | |
| | 75 dtex | | | | | 4 | 4 |

Notes)
RC: Regular crimp (7 mm gear crimp)
MC: Micro crimp (2 mm gear crimp)

As is clear from Tables 2-1 and 2-2, the fibers for artificial hair according to Example 1 of the present invention had volume (bulkiness) required as fibers for artificial hair and favorable texture, allowed smooth combing, were easy to braid, and were excellent in processability.

Example 2

Polyester Fiber

A molten polymer of a polyester resin was discharged at a barrel preset temperature of 290° C. using a melt spinning machine and using a spinning nozzle having a nozzle opening similar to that of Example 1, air cooled, and wound at a rate of 130 m/minute to obtain unstretched yarn. The obtained unstretched yarn was stretched at a rate of 30 m/minute using a 85° C. heat roll to obtain yarn stretched 3 times. The yarn was wound in succession at a rate of 30 m/minute using a heat roll heated to 200° C., heat treated, coated with finishing oil, and dried to obtain polyester fibers for artificial hair having a single yarn fineness of 36 dtex and a transverse cross sectional shape of double cross (++)

Example 3

Vinyl Chloride Fiber

A strand in which a vinyl chloride resin was melted and flowed out was introduced in a vertical direction to a heated spinning cylinder (atmosphere temperature of 320° C.) from a nozzle using a 40 mmϕ single screw extruder, while keeping the nozzle shape as it was and adjusting a cylinder head temperature to 170° C., a turn head temperature to 180° C., and a nozzle temperature to 180° C. The strand was instantaneously heat melted here. Then, unstretched yarn was wound at a constant rate with a taking up machine placed at a position about 3 m directly under the nozzle. The unstretched yarn was introduced into a stretching and heating machine, subjected to stretching treatment, and then subjected to relaxation heat treatment to produce stretched yarn. At this time, the relaxation heat treatment was fixed to 25% relaxation, and the stretching treatment was performed while adjusting the stretching ratio so that the fiber fineness of the final stretched yarn was 46 dtex. Thus, vinyl chloride fibers for artificial hair having a transverse cross sectional shape of double cross (++) were obtained.

Example 4

Figure 7:
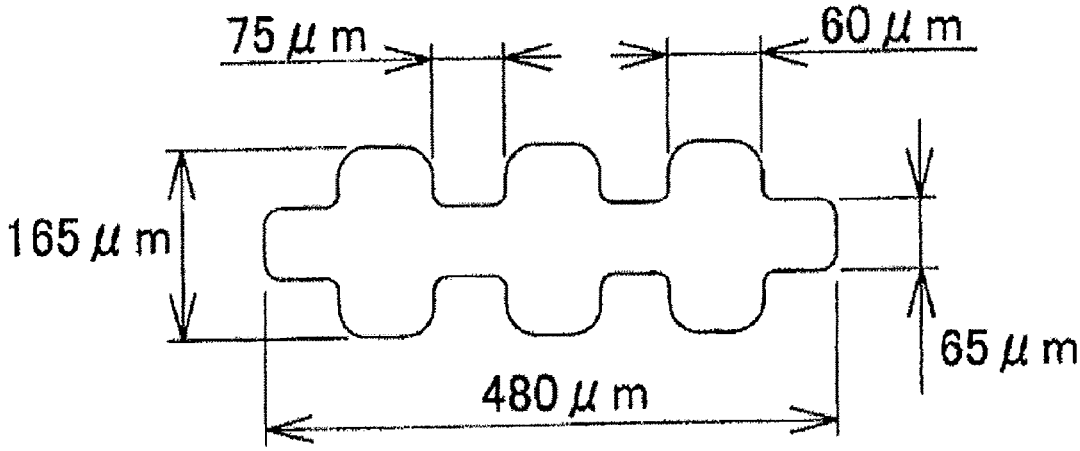
FIG. 7 is an explanatory view illustrating an example of a nozzle opening shape for obtaining the fibers for artificial hair according to the present invention.

Fibers for artificial hair having a single yarn fineness of 36 dtex and having a transverse cross sectional shape (+++; triple cross) in which three "+" were apparently connected horizontally were obtained in the same manner as in Example 1, except using a spinning nozzle (Number of openings: 100) having an opening shape in which three projections extending from each of both sides of a single major axis (lateral axis) are provided at intervals as shown in FIG. 7.

The fibers for artificial hair and braids produced in Examples 2 to 4 were evaluated for texture, smoothness of combing, ease of braiding, volume after braiding, glossiness, and difficulty of raveling. The results are shown in Table 3 together with the results of Example 1.

TABLE 3

1. Evaluation

| | Example 1 | | Example 2 | | Example 3 | | Example 4 | |
|---|---|---|---|---|---|---|---|---|
| | Cross sectional shape | | | | | | | |
| | Double cross (++) | | | | | | Triple cross (+++) | |
| | Fiber type | | | | | | | |
| | Acryl-base, 46 dtex | | Polyester-base, 36 dtex | | Vinyl chloride-base, 46 dtex | | Acryl-base, 36 dtex | |
| | Crimp shape | | | | | | | |
| Evaluation item | RC | MC | RC | MC | RC | MC | RC | MC |
| Texture | 5 | 5 | 4 | 5 | 5 | 5 | 5 | 5 |
| Smoothness of combing | 5 | 5 | 5 | 5 | 5 | 5 | 4 | 4 |
| Ease of braiding | 5 | 5 | 5 | 5 | 5 | 5 | 5 | 5 |
| Volume after braiding | 4 | 4 | 4 | 4 | 4 | 4 | 4 | 4 |
| Glossiness | 4 | 4 | 5 | 5 | 4 | 4 | 5 | 5 |
| Difficulty of raveling | 3 | 4 | 4 | 4 | 4 | 4 | 4 | 4 |

Notes)
Crimp shape
RC: Regular crimp (7 mm gear crimp)
MC: Micro crimp (2 mm gear crimp)

INDUSTRIAL APPLICABILITY

The artificial hair according to the present invention is useful particularly for hair decoration products, such as braids and extension hair.

The invention claimed is:

1. A fiber for artificial hair, comprising a transverse cross sectional shape formed of a single major axis and at least two minor axes substantially orthogonal to the major axis, in which two or three "+" are apparently put horizontally in a row, wherein a single yarn fineness is 25 to 70 dtex.

2. The fiber for artificial hair according to claim 1, comprising at least one member selected from an acrylic synthetic fiber and a vinyl chloride synthetic fiber.

3. The fiber for artificial hair according to claim 2, wherein the acrylic synthetic fiber comprises a polymer containing acrylonitrile in a proportion of 30% by weight or more in a resin component.

4. Artificial hair, comprising a synthetic fiber having a transverse cross sectional shape formed of a single major axis and at least two minor axes substantially orthogonal to the major axis, in which two or three "+" are apparently put horizontally in a row, wherein a single yarn fineness of the synthetic fiber is 25 to 70 dtex.

5. The artificial hair according to claim 4, wherein the synthetic fiber is at least one member selected from an acrylic synthetic fiber and a vinyl chloride synthetic fiber.

6. The artificial hair according to claim 5, wherein the acrylic synthetic fiber comprises a polymer containing acrylonitrile in a proportion of 30% by weight or more in a resin component.

7. The artificial hair according to claim 4, which is obtained by crimping.

8. The artificial hair according to claim 4, which is used for decorating hair on the head.

9. The artificial hair according to claim 8, which is a hair accessory selected from the group consisting of a wig, a hair piece, a braid, extension hair, and a doll's hair.

10. A hair accessory, which is obtained by bundling the artificial hair according to claim 4, and crimping the bundled artificial hair.

11. The hair accessory according to claim 10, which is obtained by braiding the bundled artificial hair.

12. The hair accessory according to claim 11, which is at least one member selected from the group consisting of wigs, hairpieces, braids, extension hair, and doll's hair.

13. The hair accessory according to claim 10, which is at least one member selected from the group consisting of wigs, hairpieces, braids, extension hair, and doll's hair.

* * * * *